United States Patent [19]

Silvia et al.

[11] 3,948,180

[45] Apr. 6, 1976

[54] NON-EXPLOSIVE SHAPED-CHARGE FOLLOW-THROUGH PROJECTILE

[75] Inventors: Denis A. Silvia, Waldorf, Md.; William N. Wishard; James R. Burns, both of Dahlgren, Va.

[73] Assignee: The United States of America as represented by the Secretary of the Navy, Washington, D.C.

[22] Filed: Mar. 17, 1975

[21] Appl. No.: 559,294

[52] U.S. Cl. ..... 102/52
[51] Int. Cl.[2] ..... F42B 13/06
[58] Field of Search ..... 102/52, 92.4

[56] References Cited

UNITED STATES PATENTS

| | | | |
|---|---|---|---|
| 2,922,366 | 1/1960 | Lyon | 102/52 |
| 3,348,485 | 10/1967 | Dufor | 102/52 |

FOREIGN PATENTS OR APPLICATIONS

| | | | |
|---|---|---|---|
| 285,801 | 5/1931 | Italy | 102/52 |
| 1,292,383 | 3/1962 | France | 102/52 |

*Primary Examiner*—Verlin R. Pendegrass
*Attorney, Agent, or Firm*—R. S. Sciascia; R. F. Beers; S. Scheinbein

[57] ABSTRACT

A penetrating member for a projectile comprising a cylindrical mass body made from a high-density material and formed with a hardened front end in the form of a concavely curved scoop with an outstanding spike in its center. One end of a tubular liner abuts the scoop, the liner being made of an easily deformable, material. When the liner hits a target, the liner is forced back along the curve of the scoop and out the center of its tubular form as a high-velocity, target-penetrating jet of material.

4 Claims, 5 Drawing Figures

NON-EXPLOSIVE SHAPED-CHARGE FOLLOW-THROUGH PROJECTILE

BACKGROUND OF THE INVENTION

This invention relates to projectiles and especially to penetration of armor by projectiles without the use of explosive charges.

Hardened penetrators in projectiles often shatter or dull upon impact, thereby lowering their area density below acceptable levels. Also the high velocities required necessitate sub-caliber designs which are inherently inefficient and pose hazards to friendly personnel from the discarded sabot. High-explosive shaped charges are suitable only for large and expensive warheads and their cost and complexity are often undesirable.

SUMMARY OF THE INVENTION

The objects and advantages of the present invention are provided by fitting a projectile with a penetration member which is located just behind its conical tip. The penetration member is comprised of a high-density, cylindrical, mass body and an easily deformable tubular liner in front of it. The liner abuts against the hardened front end of the mass body, the front end being concavely curved and having an outstanding spike in the middle. The rear end of the liner fits into the concave curve at its periphery.

An object of this invention is to provide cheaper, more efficient penetration of armor plate by a projectile than is provided by explosive-charge projectiles.

Another object is to provide more efficient penetration than that provided by hardened penetrators alone.

Other objects, advantages, and novel features of the present invention will become apparent from the following detailed description of the invention when considered in conjunction with the accompanying drawings.

DETAILED DESCRIPTION OF THE INVENTION

Figure 1:
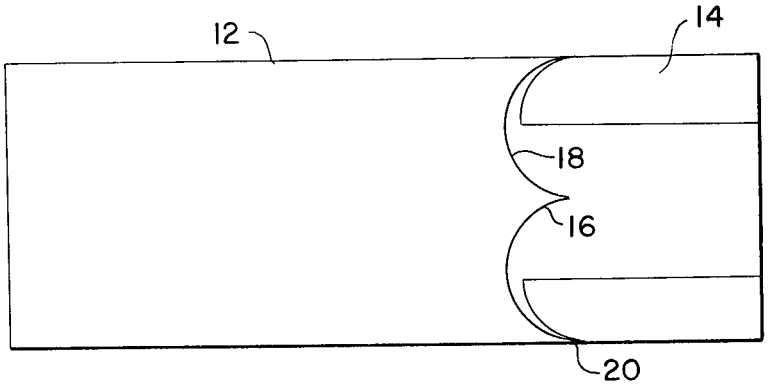
FIG. 1 is a schematic illustration of an embodiment of the invention.
Figure 4:
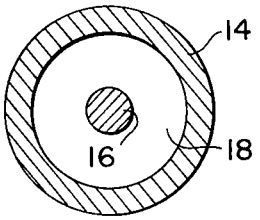
FIG. 4 is a cross-sectional view of the penetrating projectile taken along the line A — A in FIG. 3A.

A first embodiment of the invention is shown in FIG. 1. A penetrating projectile 10 is comprised of a mass body 12 and a liner 14. The mass body 12 is cylindrical and has a front end which is doubly curved in cross-section (side elevational view). The front end cross section looks like the letter *w* lying on its side, with a longer center than the two sides. The curves aare actually a single, concavely curved depression, or scoop, 18 when viewed from the front. A front view is shown in FIG. 4; this view is taken along the line A — A of FIG. 3A.

The outstanding spike 16 in the center of the scoop 18 is generally longer than the outer periphery 20, which is called the cutter. The spike 16 and scoop 18 are made of hardened metal, such as hardened steel, for example. The liner 14 is fabricated from an easily deformable, material such as aluminum, brass or copper, for example. The mass body 12 is fabricated from a high-density material, such as lead or depleted uranium, for example. It might also be made of hardened steel.

The liner 14, which is tubular, fits into the scoop 18 at the periphery of the scoop 18 and is in contact with, or abuts, the cutter 20.

Figure 2:
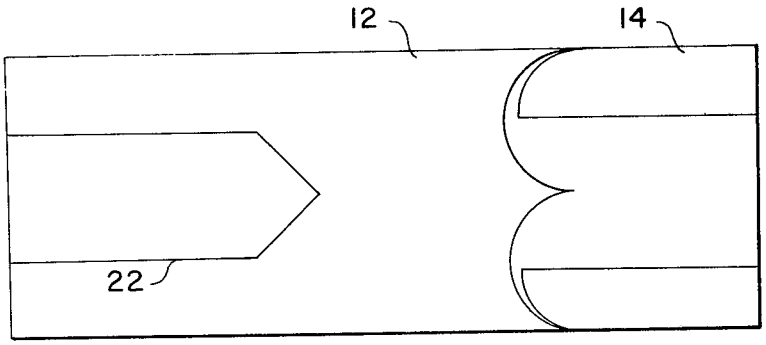
FIG. 2 is a schematic illustration of another embodiment of the invention.

In FIG. 2, the mass body 12 has an insert 22 of a material which has an even higher density than the material which forms the mass body 12. This may be useful when the material forming the mass body is more expensive than that forming the insert 22 or is lighter than desired. The insert may also be of lower density, or the excision may be unfilled, if desired, to provide desirable ballistic behavior.

Figure 3A:
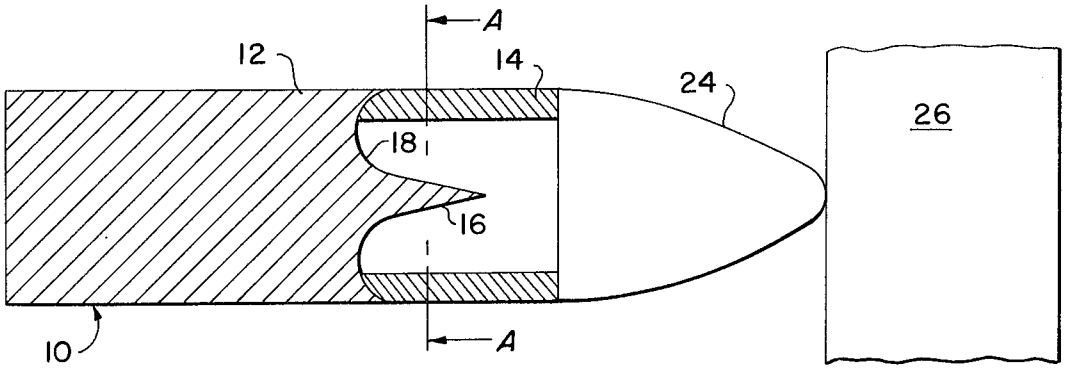
FIG. 3A is a schematic illustration of projectile employing the invention and a nose tip as the projectile is about to enter a piece of armor plate.
Figure 3B:
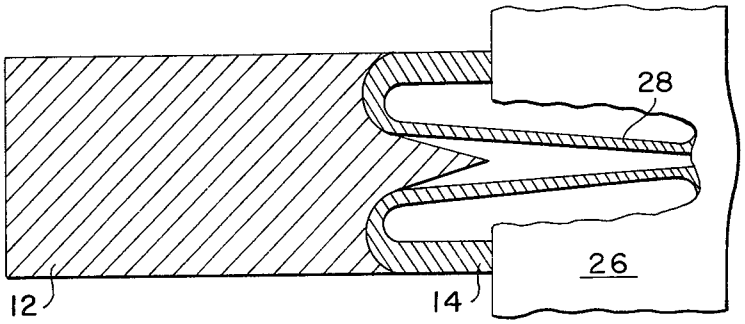
FIG. 3B is a schematic illustration of the projectile of FIG. 3A after the line jet has begun to penetrate the armor plate.

FIGS. 3A and B indicate the theory of operation of the invention. A projectile 10 comprising a conical tip 24 and a penetrating member composed of the combination of a mass body 12 and a tubular liner 14 is shown just as the front end of the tip 24 hits a section of armor plate 26 (the target). The tip 24 shatters and when the front end of the liner hits the armor plate 26, the liner 14 is driven backward. It is directed inwardly and then outwardly at great velocity by the curve of the hardened scoop 18 and the spike and drives thru the armor plate 26 as a jet 28. It is aided in driving thru the plate 26 by penetration of the spike 16 if the spike is long enough. Actually, if the spike 16 is long enough, it may start the hole thru the plate 26 and then be aided by the liner jet. Thus, according to conditions, the length of the spike relative to the length of the liner can be adjusted to provide for first penetration by the jet and support by the spike or for first penetration by the spike with dynamic support for the spike by the jet.

By adjusting parameters in re the liner thickness and ductility, the geometry of the cutter, the length of the spike and the curvature of the scoop, the amount and velocity of liner ejecta can be optimized for the desired application.

It is also possible to fabricate the liner 14 and the metal slug 22 from reactive metal, if so desired. This will add burn damage to fragmentation and penetration damage.

Obviously, many modifications and variations of the present invention are possible in light of the above teachings. It is therefore to be understood that, within the scope of the appended claims, the invention may be practiced otherwise than as specifically described.

What is claimed is:

1. A penetrating member for a projectile comprising:

a cylindrical mass body made from a high-density material with a front end in the form of a concavely curved scoop with an outstanding spike in the center of the scoop; and a tubular liner made from easily deformable material, one end of said liner abutting the scoop of said mass body, so that, when the liner hits a target, the liner is driven back along the curve of said scoop and then forward around the spike to form a high-velocity jet of material which penetrates the target.

2. A penetrating member as in claim 1, wherein the density of said liner is at least as great as the density of aluminum.

3. A penetrating member as in claim 1, wherein the length of the spike is less than half the length of the liner.

4. A penetrating member as in claim 1, wherein the length of the spike is greater than half the length of the liner.

* * * * *